US008590671B2

(12) United States Patent
Potter

(10) Patent No.: US 8,590,671 B2
(45) Date of Patent: Nov. 26, 2013

(54) LADDER STABILIZING DEVICE

(76) Inventor: Michael David Potter, Hunt's Point (CA)

( * ) Notice: Subject to any disclaimer, the term of this patent is extended or adjusted under 35 U.S.C. 154(b) by 217 days.

(21) Appl. No.: 12/857,106

(22) Filed: Aug. 16, 2010

(65) Prior Publication Data

US 2011/0147121 A1 Jun. 23, 2011

(30) Foreign Application Priority Data

Dec. 18, 2009 (CA) ..... 2690504
Feb. 18, 2010 (CA) ..... 2693530
Jun. 4, 2010 (CA) ..... 2705995

(51) Int. Cl.
*E06C 1/00* (2006.01)
*E06C 7/00* (2006.01)

(52) U.S. Cl.
USPC ..... 182/107; 182/108; 182/109; 182/111; 182/165; 182/170; 182/171

(58) Field of Classification Search
USPC ..... 182/107, 108, 109, 111, 165, 170, 171
See application file for complete search history.

(56) References Cited

U.S. PATENT DOCUMENTS 4,164,269 A * 8/1979 Jackson ..... 182/229
4,565,262 A * 1/1986 Hawkins ..... 182/116
4,632,220 A * 12/1986 Murrell ..... 182/111
4,641,729 A * 2/1987 Beck et al. ..... 182/172
4,723,629 A * 2/1988 Vanden Hoek et al. ..... 182/107
4,792,016 A * 12/1988 Ingalsbe et al. ..... 182/107
4,872,529 A * 10/1989 Viets ..... 182/172
4,899,849 A * 2/1990 Levi et al. ..... 182/172
5,462,133 A * 10/1995 Merrill et al. ..... 182/172
5,779,001 A * 7/1998 Skyba ..... 182/107
5,857,544 A * 1/1999 Del Sole ..... 182/180.3
5,868,222 A * 2/1999 Charbonneau ..... 182/172
6,095,284 A * 8/2000 Smith ..... 182/103
6,189,653 B1 * 2/2001 Laug ..... 182/152
6,527,084 B2 * 3/2003 Hrincu ..... 182/172
6,672,427 B1 * 1/2004 Sheffield ..... 182/172
6,955,243 B1 * 10/2005 Huff ..... 182/107
7,614,480 B2 * 11/2009 Smiley ..... 182/64.1
7,753,170 B1 * 7/2010 Gibson ..... 182/107
7,757,814 B2 * 7/2010 Pleadwell et al. ..... 182/172
2007/0181369 A1 * 8/2007 Gibson et al. ..... 182/165
2009/0159367 A1 * 6/2009 Ortiz Perez ..... 182/111

* cited by examiner

*Primary Examiner* — Katherine Mitchell
*Assistant Examiner* — Colleen M Chavchavadze
(74) *Attorney, Agent, or Firm* — Walters & Wasylyna LLC

(57) ABSTRACT

A device for stabilizing a ladder including a first stabilizing member having a predetermined fixed first length, a second stabilizing member having a predetermined fixed second length, a support structure for being mounted to the ladder at a predetermined location, the support structure being mounted to an upper portion of the first and the second stabilizing member, respectively, the support structure for holding the upper portion of the first and the second stabilizing member in proximity of a first frame rail and a second frame rail of the ladder, respectively, such that the first and the second stabilizing members are rotatable around a first axis oriented substantially parallel to rungs of the ladder, and a connecting member having a predetermined length removable mounted to the first and second stabilizing member at a predetermined distance to the upper portion of the first and second stabilizing member.

8 Claims, 14 Drawing Sheets

LADDER STABILIZING DEVICE

FIELD

This patent application claims priority from Canadian Patent Application Nos. 2,690,504 filed Dec. 18, 2009; 2,693,530 filed Feb. 18, 2010; and 2,705,995 filed Jun. 4, 2010. The entire contents of all three Canadian patent applications are incorporated herein by reference.

FIELD OF THE INVENTION

The present invention relates to the field of ladder stabilizing devices, and more particularly to a ladder stabilizing device for stabilizing an extension ladder to prevent the extension ladder from slipping sideways.

BACKGROUND OF THE INVENTION

Extension ladders are very effective tools enabling a person to reach locations high above ground in a simple fashion for performing various tasks such as, for example, cleaning, painting, or repair. Extension ladders are commonly used by workers in performance of their occupation as well as individuals performing various tasks in a do-it-yourself fashion. Extension ladders usually comprise two or more ladder portions with each ladder portion having a pair of parallel frame rails spaced apart and connected by a plurality of rungs. Typically, an upper portion of an extension ladder is leaned against a supporting surface such as, for example, a wall or roof structure of a building. When properly placed on a flat and stable surface extension ladders are usually relatively stable.

However, accidents frequently occur because the upper portion of the extension ladder is slipping sideways. Such accidents are particularly likely when the extension ladder is used on uneven or sloping ground and when a person is leaning out at or near the top of the extension ladder, thereby causing a fall resulting in severe injuries or death.

Various ladder stabilizing devices have been disclosed such as, for example, in: U.S. Pat. No. 7,163,084 (Blehm); U.S. Pat. No. 6,672,427 (Sheffield); U.S. Pat. No. 6,527,084 (Hrincu); U.S. Pat. No. 5,868,222 (Charbonneau); and U.S. Pat. No. 4,949,809 (Levi et al.). Unfortunately, these devices are complex and cost intensive to manufacture by employing telescopic components, difficult to install by having to mount various components to the ladder at more than two locations, and cumbersome to use by having to transport the various components and setting the various components up in a proper fashion.

It is desirable to provide a ladder stabilizing device for stabilizing an extension ladder that is simple to set up.

It is also desirable to provide a ladder stabilizing device for stabilizing an extension ladder that is simple to mount to an existing extension ladder.

It is also desirable to provide a ladder stabilizing device for stabilizing an extension ladder that is simple and cost effective to manufacture.

SUMMARY OF THE INVENTION

Accordingly, one object of the present invention is to provide a ladder stabilizing device for stabilizing an extension ladder that is simple to set up.

Another object of the present invention is to provide a ladder stabilizing device for stabilizing an extension ladder that is simple to mount to an existing extension ladder.

Another object of the present invention is to provide a ladder stabilizing device for stabilizing an extension ladder that is simple and cost effective to manufacture.

According to one aspect of the present invention, there is provided a device for stabilizing a ladder. The device for stabilizing a ladder comprises a first stabilizing member having a predetermined fixed first length and a second stabilizing member having a predetermined fixed second length. The device for stabilizing a ladder further comprises a support structure for being mounted to the ladder at a predetermined location. The support structure is mounted to an upper portion of the first and the second stabilizing member, respectively. The support structure holds the upper portion of the first and the second stabilizing member in proximity of a first frame rail and a second frame rail of the ladder, respectively, such that the first and the second stabilizing members are rotatable around a first axis oriented substantially parallel to rungs of the ladder. A connecting member having a predetermined length is removable mounted to the first and second stabilizing member at a predetermined distance to the upper portion of the first and second stabilizing member.

According to another aspect of the present invention, there is further provided a device for stabilizing a ladder. The device for stabilizing a ladder comprises a support structure for being mounted to the ladder at a predetermined location and for being mounted to an upper portion of a first and a second stabilizing member, respectively. In operation, the support structure holds the upper portion of the first and the second stabilizing member in proximity of a first frame rail and a second frame rail of the ladder, respectively, such that the first and the second stabilizing members are rotatable around a first axis oriented substantially parallel to rungs of the ladder. The device further comprises a securing structure for connecting a lower portion of the first and the second stabilizing member with a respective lower portion of the ladder.

The advantage of the present invention is that it provides a ladder stabilizing device for stabilizing an extension ladder that is simple to set up.

A further advantage of the present invention is that it provides a ladder stabilizing device for stabilizing an extension ladder that is simple to mount to an existing extension ladder.

A further advantage of the present invention is that it provides a ladder stabilizing device for stabilizing an extension ladder that is simple and cost effective to manufacture.

BRIEF DESCRIPTION OF THE DRAWINGS

A preferred embodiment of the present invention is described below with reference to the accompanying drawings, in which.

DESCRIPTION OF THE PREFERRED EMBODIMENTS

Figure 1A:
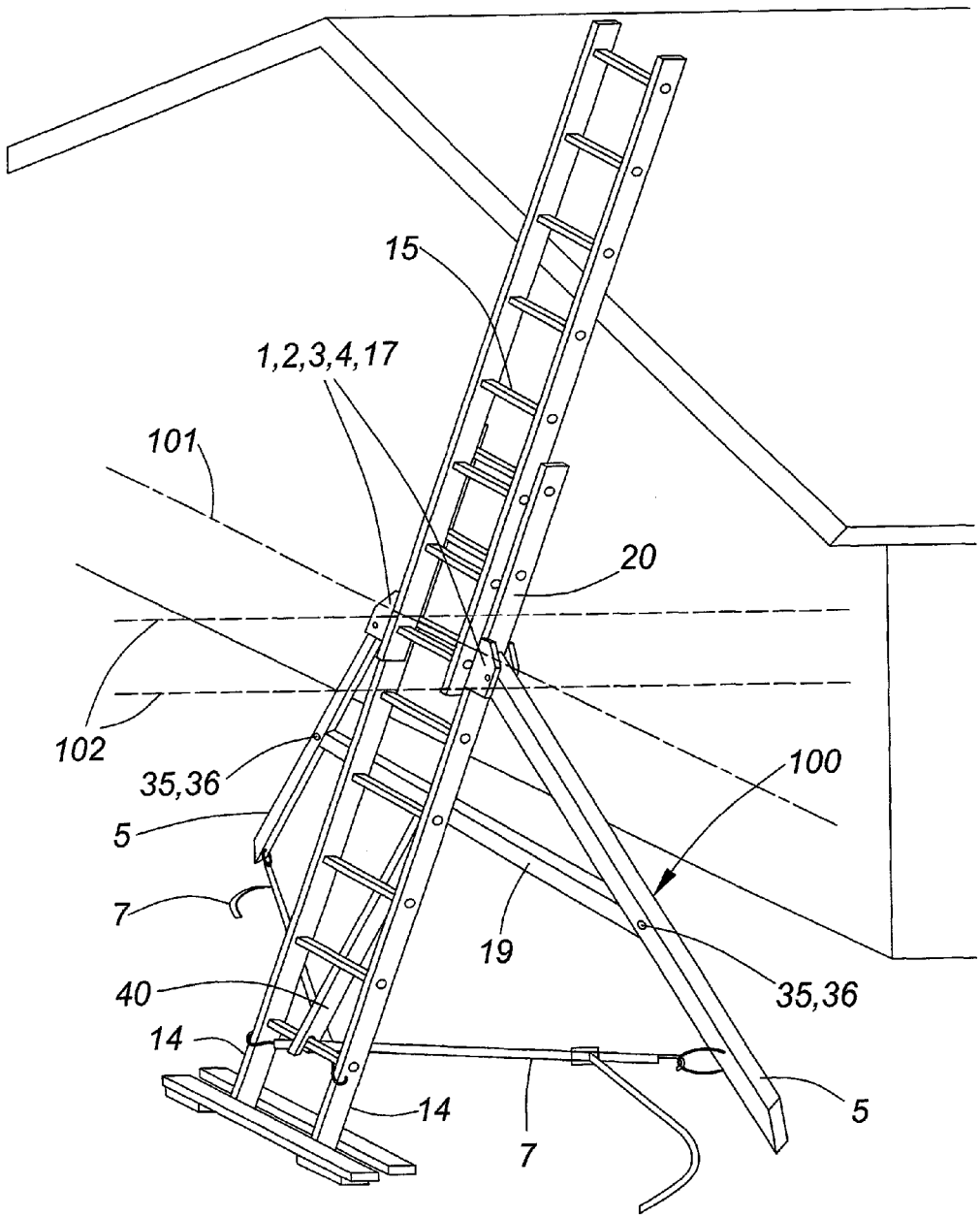
FIG. 1*a* is a simplified block diagram illustrating a perspective view of a ladder stabilizing device according to a preferred embodiment of the invention.

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described.

While embodiments of the invention will be described for use with an extension ladder for the sake of simplicity, it will become evident to those skilled in the art that the embodiments of the invention are not limited thereto, but are also applicable for use with other types of ladders such as, for example, non-extendable ladders and folding ladders.

Referring to FIGS. 1*a* to 1*e*, a ladder stabilizing device 100 according to a preferred embodiment of the invention is provided. The ladder stabilizing device 100 according to the preferred embodiment of the invention comprises a first and a second stabilizing member 5 with each having a predetermined fixed length. The fixed length is determined such that a user is enabled to stabilize a ladder 20 on an uneven or sloped surface as will be described herein below. A support structure 1, 2, 3, 4, and 17 is mounted to the ladder 20 at a predetermined location, preferably at the sixth rung 15 from the bottom of the ladder 20 enabling use of same length—preferably in the range between 70 and 80 inches—stabilizing members 5 for a wide range of different lengths of the ladder 20. Alternatively, the length of the stabilizing members 5 is varied dependent upon the overall length of the extended ladder 20. The support structure 1, 2, 3, 4, and 17 is mounted to an upper portion of the first and the second stabilizing member 5, respectively. The support structure holds the first and the second stabilizing member 5 in proximity of a left hand side frame rail 14 and a right hand side frame rail 14 of the ladder 20, respectively. Preferably, each of the first and the second stabilizing members 5 is independently rotatable around a first axis 101 oriented substantially parallel to rungs 15 of the ladder 20 and around a second axis 102 oriented substantially perpendicular to the first axis 101 to facilitate set-up of the ladder stabilizing device 100. Alternatively, the first and the second stabilizing members 5 are mounted such that they are rotatable only around the first axis in an independent or connected fashion. The stabilizing members 5 are held in a fixed relation with respect to each other via a brace 19, preferably have bevels 19*c* at both ends thereof, which brace 19 is removable mounted thereto using, for example, carriage bolts 35 and wing nuts 36 accommodated in respective bores 19*a* and 19*b*. A center support 40, preferably made of wood or other solid material is engaged with a lower rung of the ladder by way of, for example, a cut 42 or groove therein, the other end of the center support 40 having attachment means including for example a threaded rod 44 securely inserted therein and having an exposed threaded length extending beyond the end thereof, adapted to passed through a corresponding notch 48 or hole in the brace and being securable to the brace by, for example, a pair of washers 50 and wingnuts 52 securely engaging opposite sides of the brace in a conventional manner as illustrated in FIGS. 3F and 3G, or such other attachment means known to a person skilled in the art. The center support 40 makes the ladder more stable and reduces the likelihood that the ladder will become unstable should the ladder be lifted or moved, for example, by an individual lifting the ladder at the roofline. The stabilizing members 5 are then secured to the ladder 20 via a substantially non-elastic securing mechanism of adjustable length 7 such as, for example, two cam-lock tie-down straps, preferably forming a criss-cross pattern.

Figure 1B:
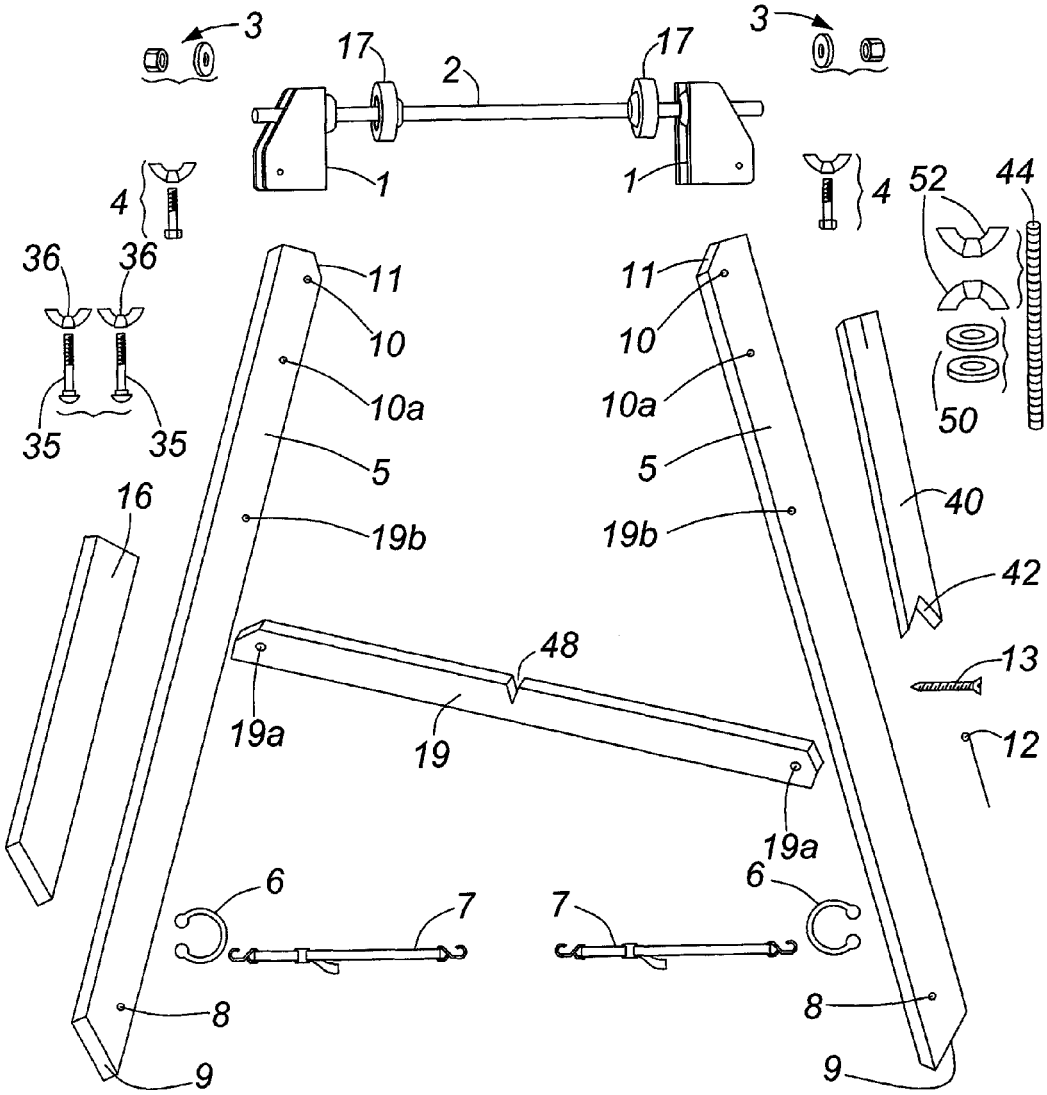
FIG. 1*b* is a simplified block diagram illustrating an exploded view of the ladder stabilizing device according to a preferred embodiment of the invention.
Figure 1C:
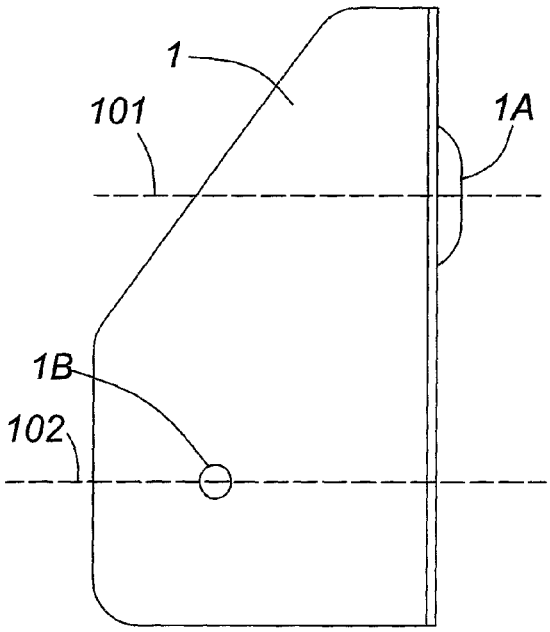
FIGS. 1*c* and 1*d* are simplified block diagrams illustrating a side view and a front view, respectively, of a hinge bracket of the ladder stabilizing device according to a preferred embodiment of the invention.
Figure 1D:
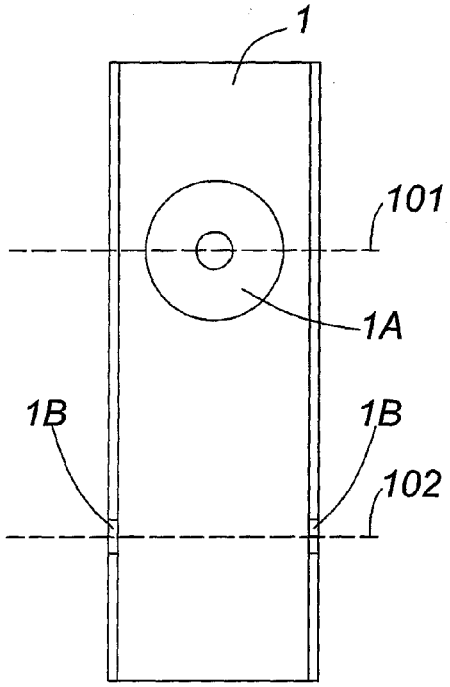
Figure 1E:
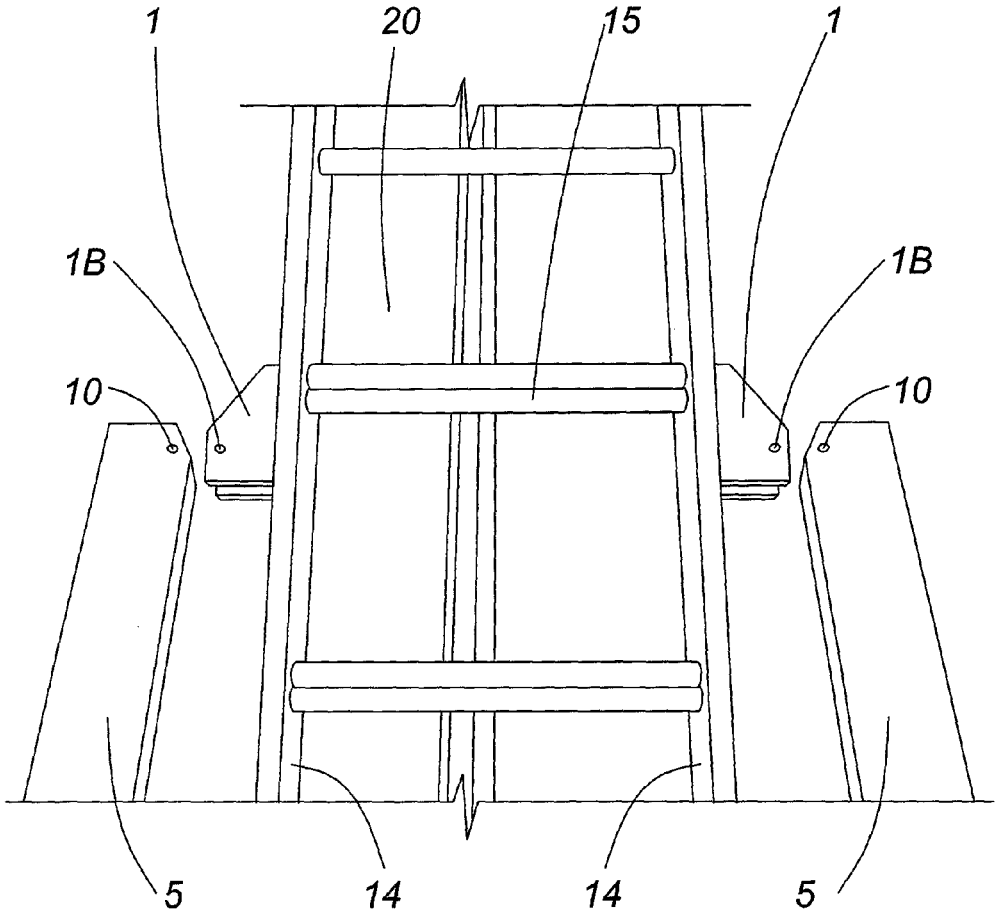
FIG. 1*e* is a simplified block diagram illustrating a front view of a portion of an extension ladder with the support structure of the ladder stabilizing device according to a preferred embodiment of the invention.
Figure 1F:
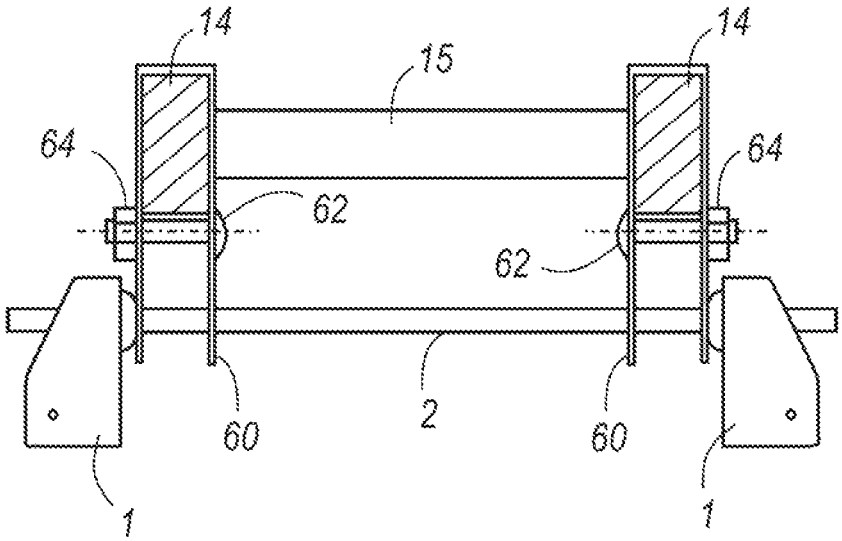
FIG. 1*f* is a simplified block diagram illustrating an alternative embodiment for mounting the support structure of the ladder stabilizing according to a preferred embodiment of the invention.
Figure 1G:
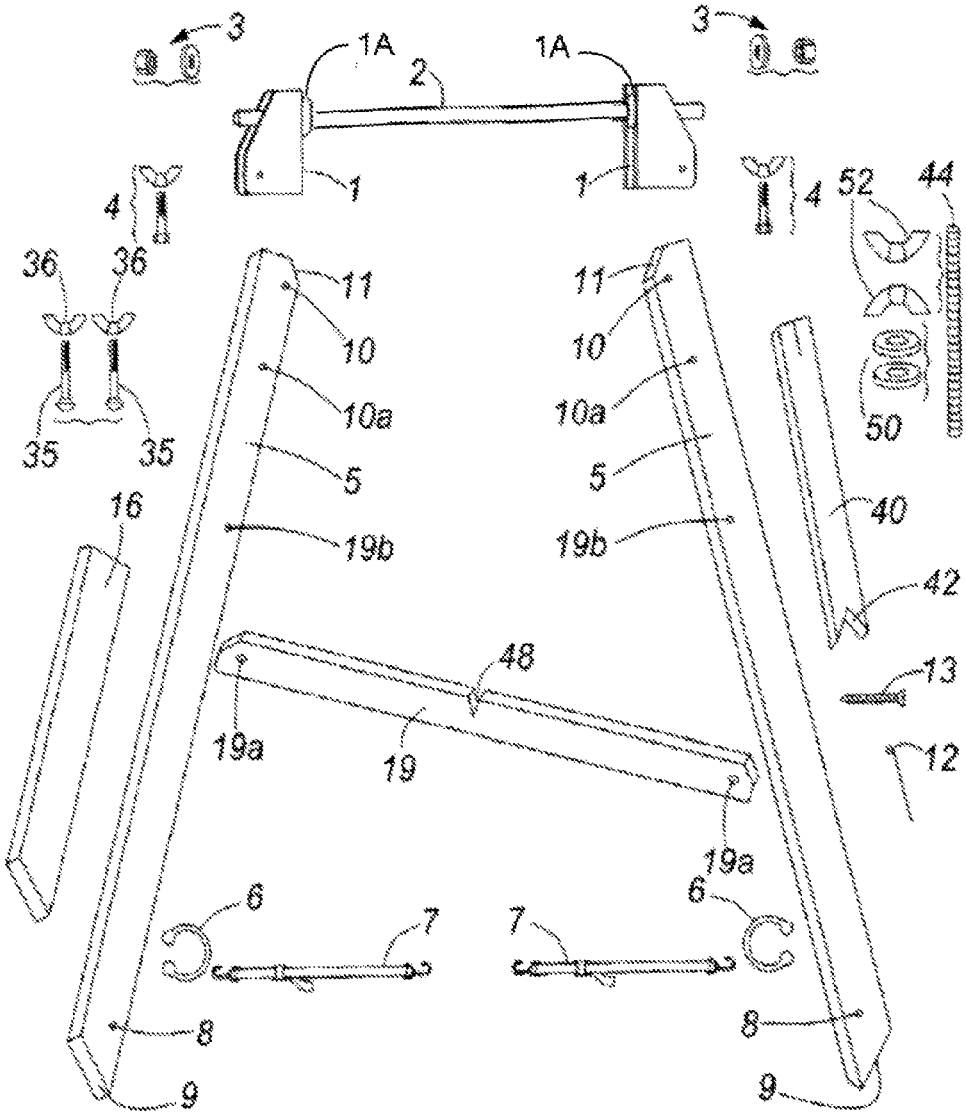
FIG. 1*g* is a simplified block diagram illustrating an exploded view of the ladder stabilizing device according to a preferred embodiment of the invention.

FIGS. 1*b* and 1*g* illustrate exploded views of the ladder stabilizing device 100 according to the preferred embodiment of the invention. Preferably, the support structure comprises a rod 2—for example, a threaded rod or a rod having threaded end portions made of stainless steel or Zinc plated steel—for being mounted to the ladder 20. The rod 2 forms the first axis 101 and has at each of the threaded end portions a U-shaped hinge bracket 1 mounted thereto using typical hardware such as, for example, flat washers and self-locking nuts 3 such that the hinge brackets 1 are enabled to pivot around the rod 2 using, for example, a predetermined torque setting when fastening the nuts. Preferably, the rod 2 is disposed within a bore of a hollow rung 15 of the ladder 20 and centered using a centering member. Depending on the size of the bore an embossment 1A of the hinge bracket 1 is used as centering member, as illustrated in FIGS. 1*c*, 1*d* and 1*g*. Alternatively, a self-centering washer 17—for example, a self-centering Nylon washer—is employed, as illustrated in FIG. 1*b*. The end portion of each of the first and the second stabilizing member 5 is accommodated between flaps of the respective U-shaped hinge bracket 1 and mounted thereto using typical mounting hardware 4 comprising, for example, a hex bolt and a self-locking nut. The bolt is disposed in bore 10 of the stabilizing member 5 and respective bores 1B in the flaps of the U-shaped hinge bracket 1 and is then fastened to a predetermined torque using the respective self-locking nut to enable the stabilizing members 5 to rotate around the bolt forming the axis 102. Alternatively, if stabilizing members 5 are employed having a greater length than the distance between the location the support structure is mounted to the ladder 20 and the bottom of the ladder 20, additional bores 10A are provided for holding the stabilizing members 5 in a transport position. Preferably, the stabilizing members 5 are removable mounted to the hinge bracket 1 using carriage bolts and wing nuts. During setup the stabilizing members 5, removable mounted to the hinge brackets 1 at the bores 10A, are removed therefrom and mounted to the respective hinge brackets 1 again using the bores 10.

Preferably, the stabilizing members 5 are made of commercially available lumber such as, for example, 2×4 wood material having a length of 77 inches. Of course, other materials are also employable as stabilizing members 5, for example, fiberglass. However, 2×4 boards are preferred because they are readily available, easy to cut, relatively light weight, and electrically non-conducting. The boards are cut to the predetermined length, preferably, 77 inches or the distance between the location where the stabilizing member 5 is mounted to the ladder 20 and the bottom end of the frame rail 14 of the ladder 20. A clearance 11 is cut at the top end portion of the stabilizing member 5 to enable rotation of the stabilizing member 5 about the axis 102 and a miter cut 9 is provided at the bottom portion of the stabilizing member 5 to improve ground engagement of the stabilizing member 5. Alternatively, a base member having a substantially flat surface for engaging uneven or sloped ground is rotatable attached to the bottom portion of the stabilizing members 5.

Preferably, the brace 19 is made of commercially available lumber such as, for example, 2×4 wood material cut to a predetermined length. The brace 19 comprises bores 19*a* for being removable mounted to in the stabilizing members 5 via respective bores 19*b* disposed therein using carriage bolts 35 and wing nuts 36.

Optionally, a level and angle of inclination indicator 12—made of, for example, wire—is loosely mounted to one of the stabilizing members 5 using, for example, wood screws 13 at a location where it can be easily viewed when the ladder 20 is in an upright position. At the location of the indicator 12, a line is inscribed on the stabilizing member 5 representing approximately a 15° angle to the vertical. Use of the level and angle of inclination indicators 12 will be described herein below.

Preferably, a securing structure directly connects the bottom portions of the stabilizing members 5 to the bottom portion of the ladder 20. The securing structure comprises, for example, two cam-lock tie-down straps 7 with each one of the straps 7 being securely attached to a bottom portion of a respective rail 14. During set-up the opposite end of each of the cam-lock tie-down straps 7 are attached to a bottom portion of the stabilizing members 5, for example, by accommodating a hook of the cam-lock tie-down strap 7 in a respective bore disposed in the stabilizing member 5 or loop 6 mounted thereto. Preferably, the cam-lock tie-down straps 7 are attached to the stabilizing members 5 forming a criss-cross pattern. During transport and storage the cam-lock tie-down straps 7 are used to tie each of the stabilizing members 5 to the respective rail 14.

The ladder stabilizing device 100 is easy to manufacture using off-the-shelf hardware components, as well as easy to assemble and install. For example, the components described herein above and illustrated in FIG. 1*b* are provided as a kit for the customer to assemble and install using standard do-it-yourself tools. To save space and shipping cost the stabilizing members 5 are not provided but are readily available, for example, as standard 2×4 wood material at any lumber or home improvement store. Furthermore, the same ladder stabilizing device 100 is employable for a wide variety of extension ladders.

Alternatively, as illustrated in FIG. 1*f*, the rod 2 is mounted to the frame rails 14 of the ladder 20 using, for example, two U-shaped brackets 60 designed such that the flaps of the U-shaped brackets 60 accommodate the respective frame rail 14 there between. The U-shaped bracket 60 is clamped to the frame rail 14 using a bolt 62 and locking nut 64. The rod 2 is accommodated in respective bores disposed at a predetermined location in the flaps of the U-shaped brackets 60 and mounted thereto using standard hardware components as described herein above. Employment of the U-shaped brackets 60 enables mounting of the ladder stabilizing device 100 to ladders absent hollow rungs without weakening the structure of the ladder by drilling holes into the frame rails.

Figure 2A:
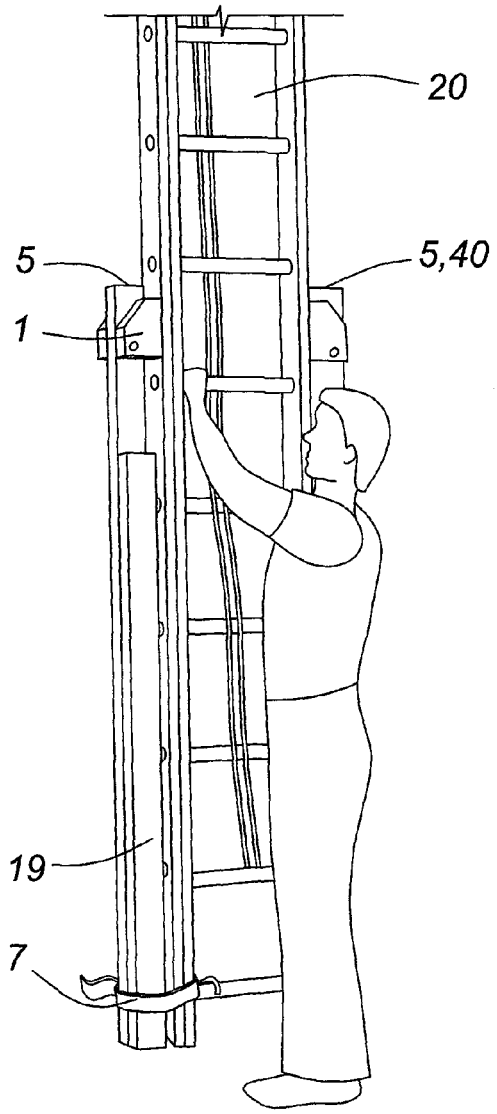
FIGS. 2*a* and 2*b* are simplified block diagrams illustrating an extension ladder with the ladder stabilizing device according to a preferred embodiment of the invention in a transport position.
Figure 2B:
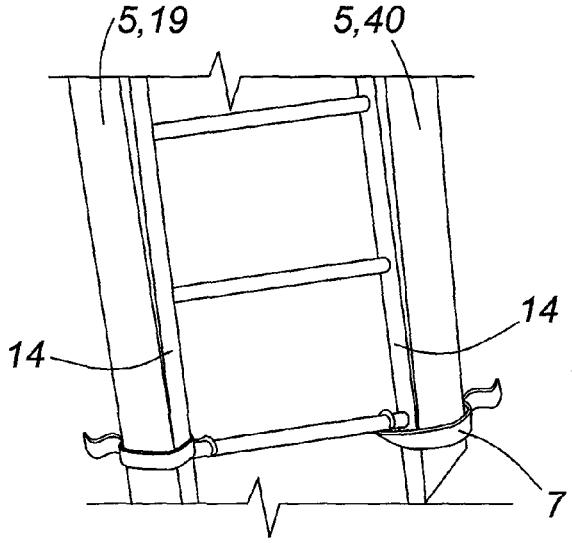

FIGS. 2*a* and 2*b* illustrate an extension ladder 20 having the ladder stabilizing device mounted thereto and the stabilizing elements 5 secured to the outside of the frame rails of the ladder 20. Preferably, the cam-lock tie-down straps 7 are used for securing the stabilizing elements 5 to the frame rails during storage, transport and handling of the ladder 20, thus minimizing the number of components employed. Further preferably, both the brace 19 and the center support 40 is removable mounted to one of the stabilizing members 5 using, for example, carriage bolts 35 and wing nuts 36 accommodated in respective bores disposed in the brace 19, the center support 40 and the stabilizing member 5. As is evident, the extension ladder 20 with the ladder stabilizing device 100 is easily to transport and no additional components need to be carried.

Figure 3A:
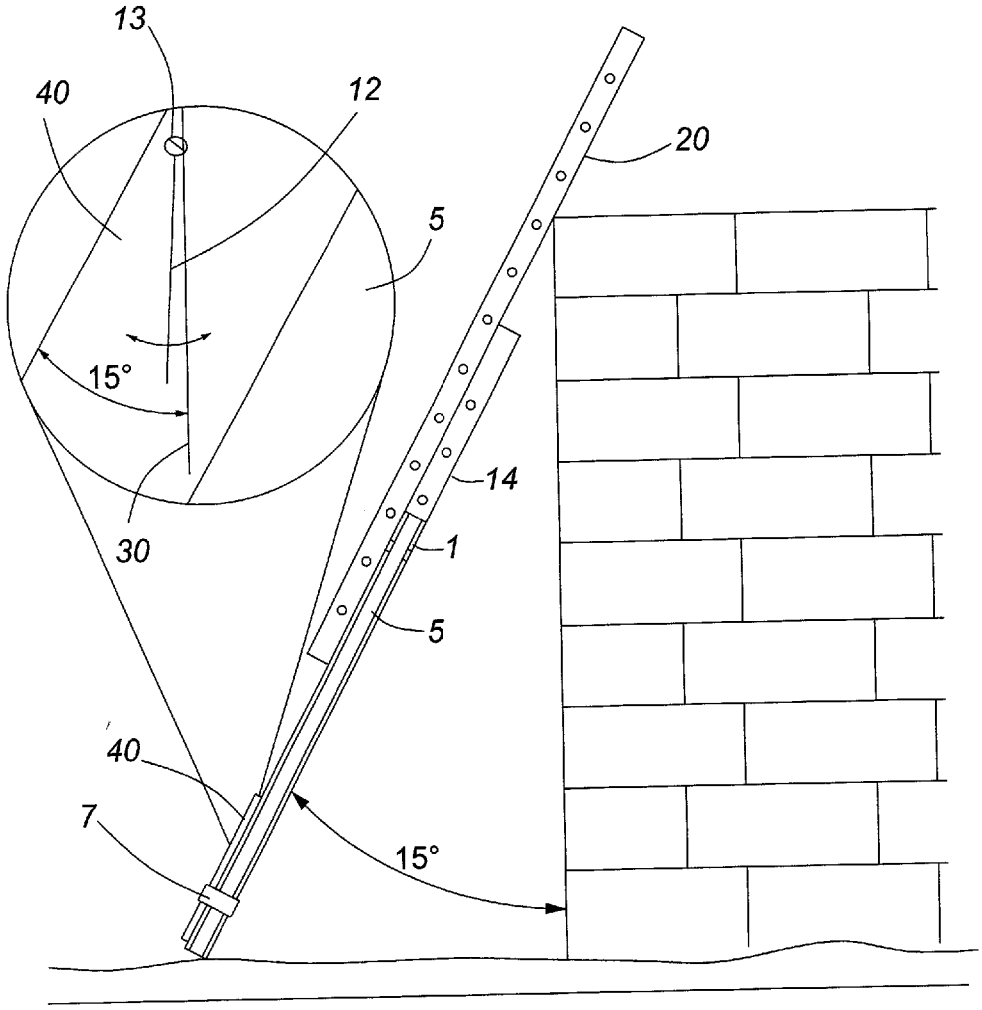
FIG. 3*a* is a simplified block diagram illustrating a side view of an erected extension ladder with the ladder stabilizing device according to a preferred embodiment of the invention in a transport position.

The extension ladder 20 with the ladder stabilizing device 100 is erected in the usual fashion and leaned against a surface such as a wall, as illustrated in FIG. 3*a*. Of course, care has to be taken that the extension ladder 20 is securely anchored. If the ground is sloped or uneven, then the bottom end of the extension ladder 20 is leveled, for example, by disposing shims under the floating frame rail of the extension ladder 20. To ensure placement of the extension ladder 20 at a correct angle of approximately 15°, the extension ladder 20 is adjusted until the indicator 12 is approximately aligned with the line 30 marked on the stabilizing member 5.

Figure 3B:
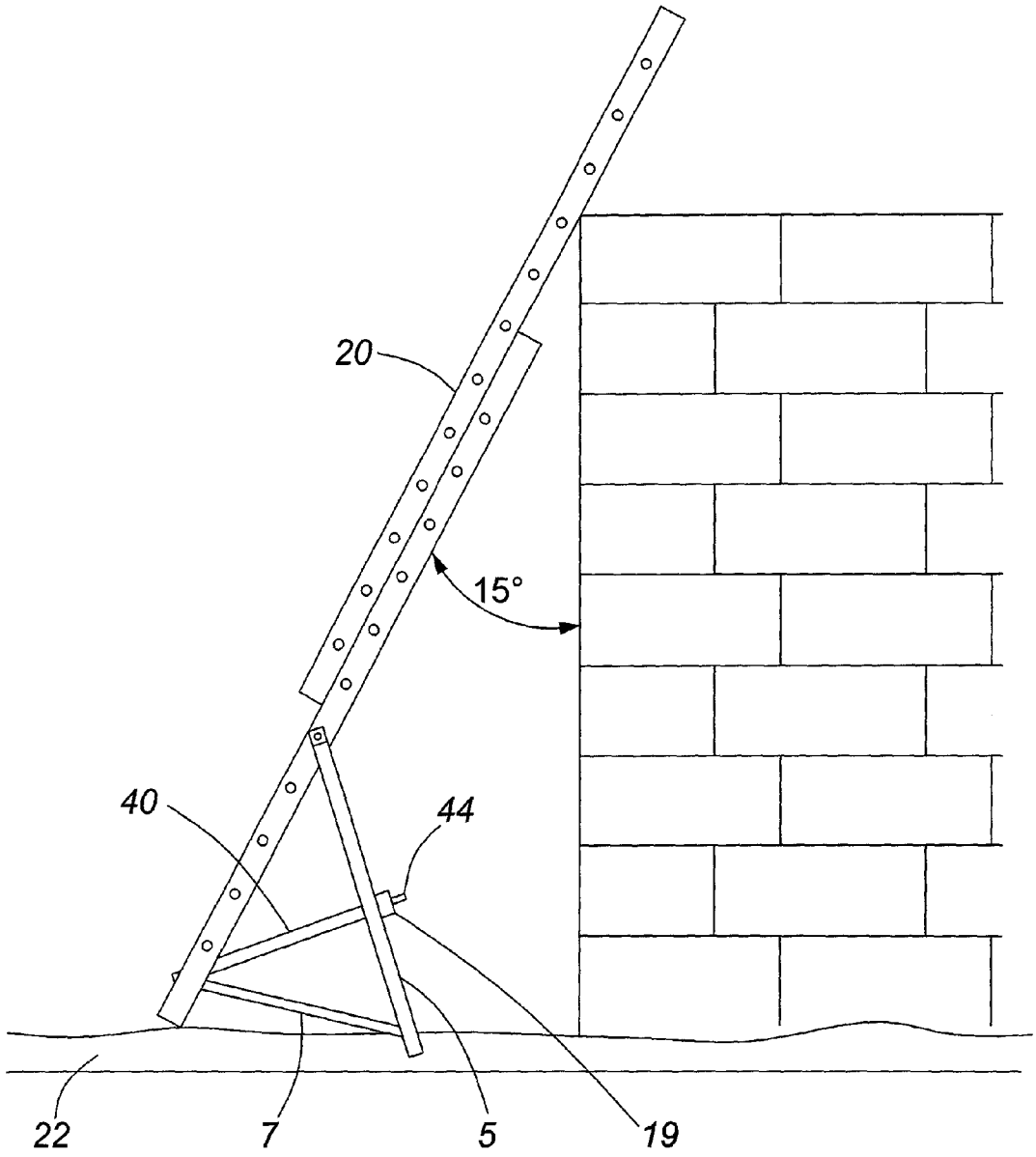
FIG. 3*b* is a simplified block diagram illustrating a side view of an erected extension ladder with the ladder stabilizing device according to a preferred embodiment of the invention set up.
Figure 3C:
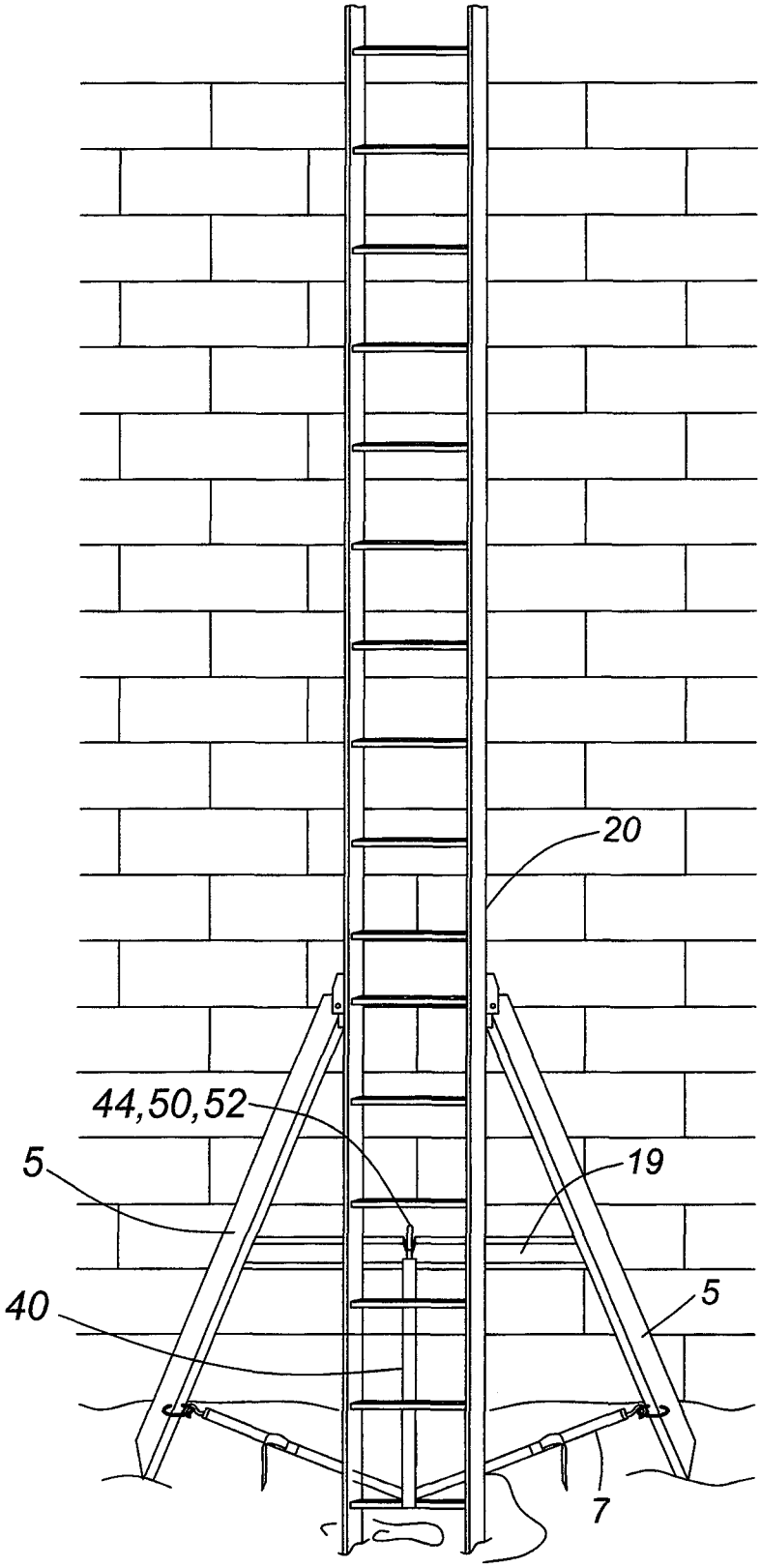
FIG. 3*c* is a simplified block diagram illustrating a front view of an erected extension ladder with the ladder stabilizing device according to a preferred embodiment of the invention set up.
Figure 3D:
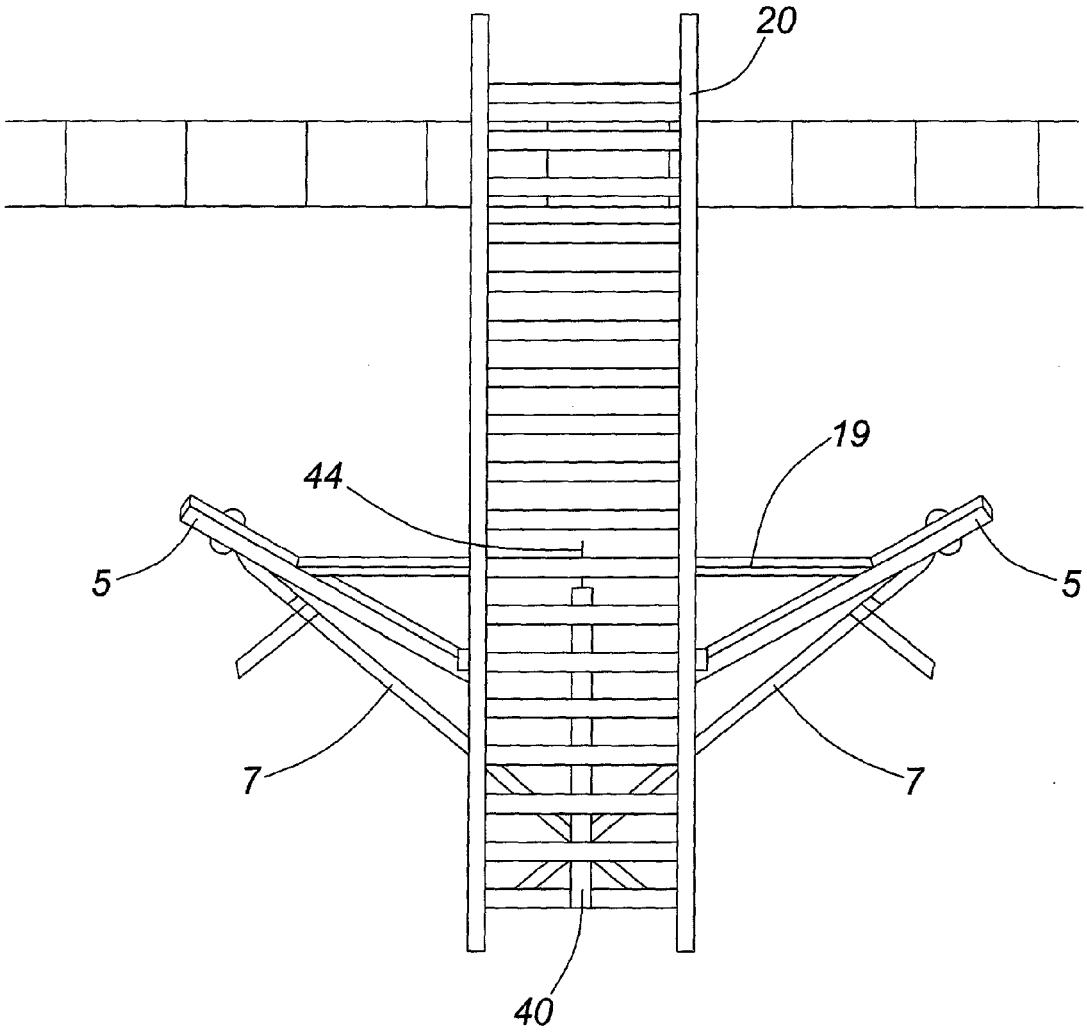
FIG. 3*d* is a simplified block diagram illustrating a top view of an erected extension ladder with the ladder stabilizing device according to a preferred embodiment of the invention set up; and, FIG. 3*e* is a simplified block diagram illustrating a front view of an erected extension ladder with the ladder stabilizing device according to a preferred embodiment of the invention set up and with one stabilizing element having an extension mounted thereto.

After the extension ladder 20 is erected the cam-lock tie-down straps 7 are removed from the storage and transport position. The stabilizing members 5 mounted to the hinge brackets in bores 10A are removed therefrom and mounted thereto again using bores 10. The stabilizing members are then swung outwards from the frame rails 14 around the axes 102 as well as towards the wall around the axis 101 until they are lowered at an inverse angle towards the base of the wall and the ground 22, as illustrated in FIGS. 3*b* to 3*d*. In this position the stabilizing members 5 are then connected to each other by mounting the brace 19 thereto using carriage bolts 35 and wing nuts 36 accommodated in respective bores 19*a* and 19*b* and the center support attached to the ladder and brace as described herein above. The stabilizing members 5 are then engaged with the ground 22 and the bottom portions of the stabilizing elements 5 are connected to the bottom portion of the ladder 20 using the cam-lock tie-down straps 7, as described herein above, and fastened to prevent the same from slipping during use of the extension ladder 20. On soft ground, the miter cut tips 9 of the stabilizing elements 5 are pushed to penetrate into the ground. When set up, the stabilizing elements 5 form an approximate inverted V-shape, as illustrated in FIG. 3*c* showing a set up on approximate level ground 22.

Figure 3E:
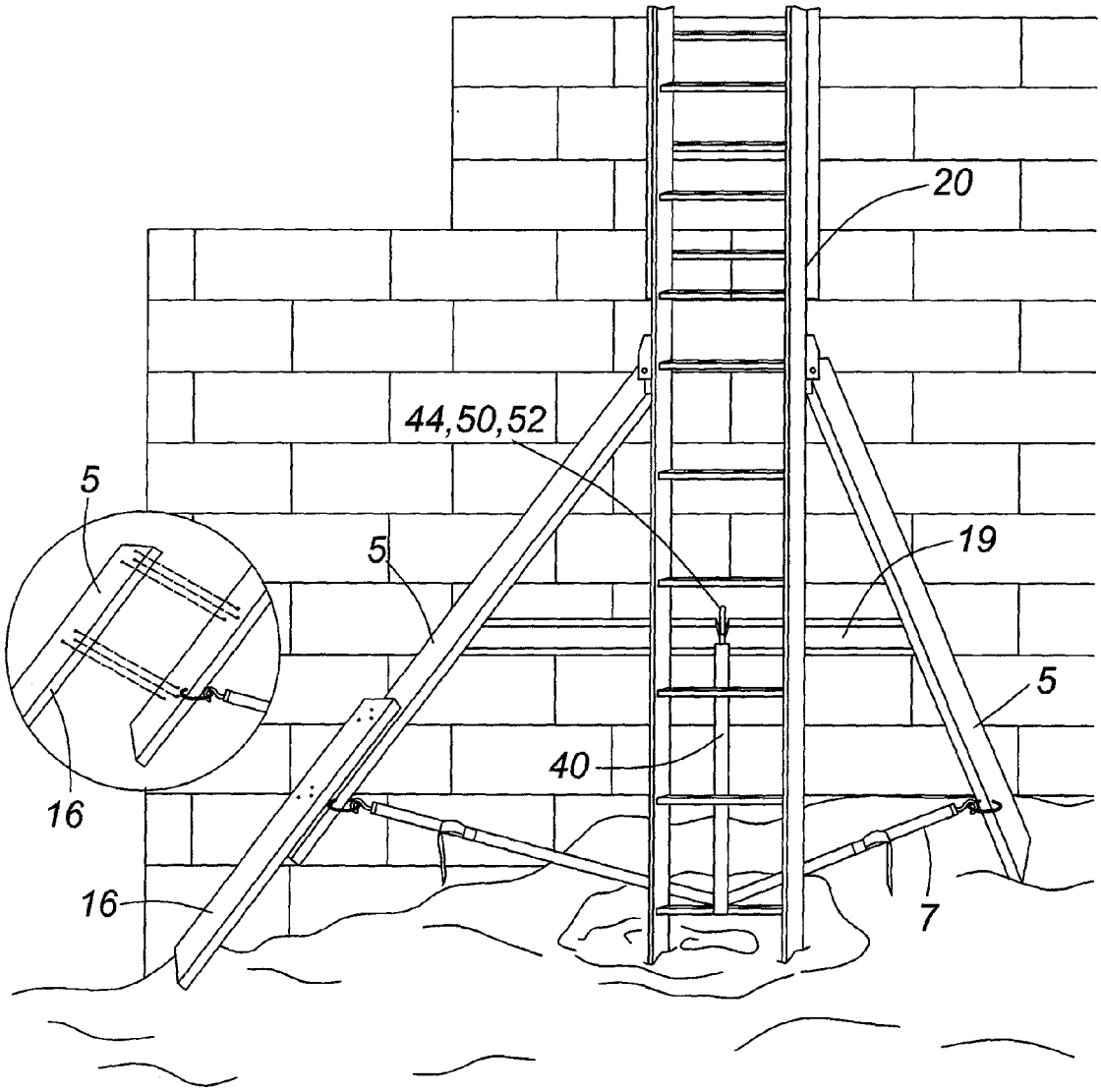
FIG. 3*f* is a simplified block diagram illustrating a side view, partially in ghost, of the center support installed on the ladder.
FIG. 3*g* is a simplified block diagram illustrating a portion of the brace in one embodiment of the present invention; and, FIG. 3*h* is a perspective view of a brace in one embodiment of the present invention.
Figure 3F:
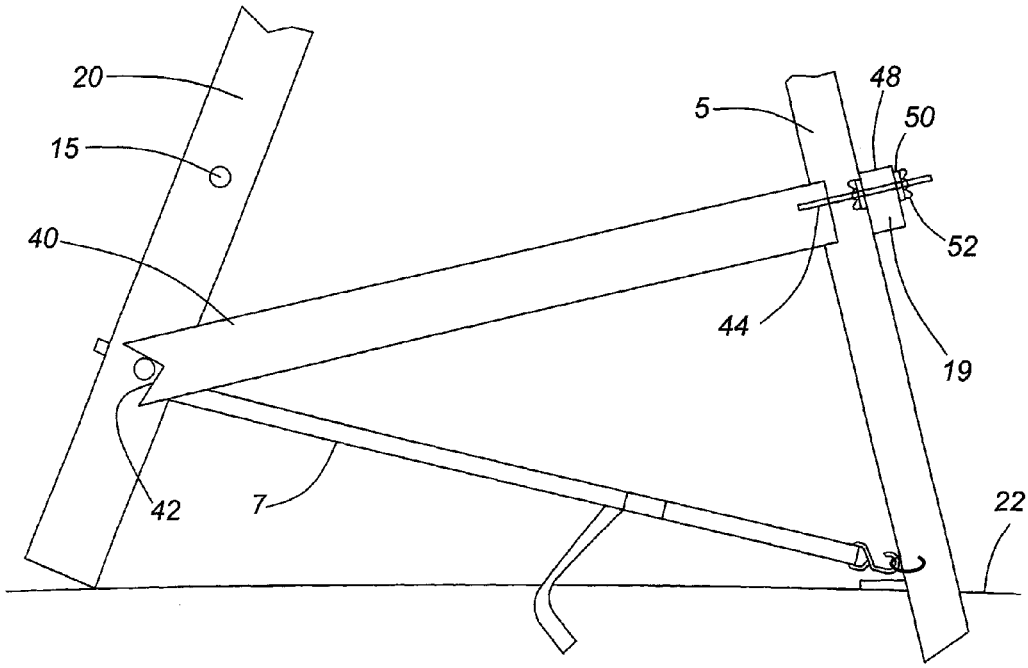
Figure 3G:
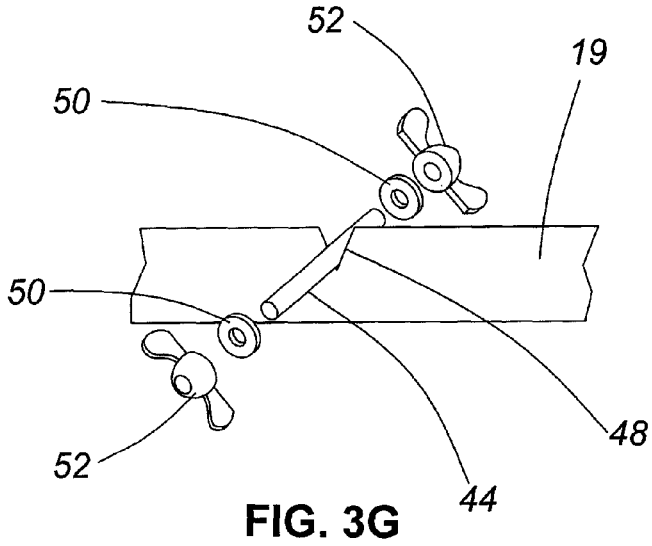
Figure 3H:
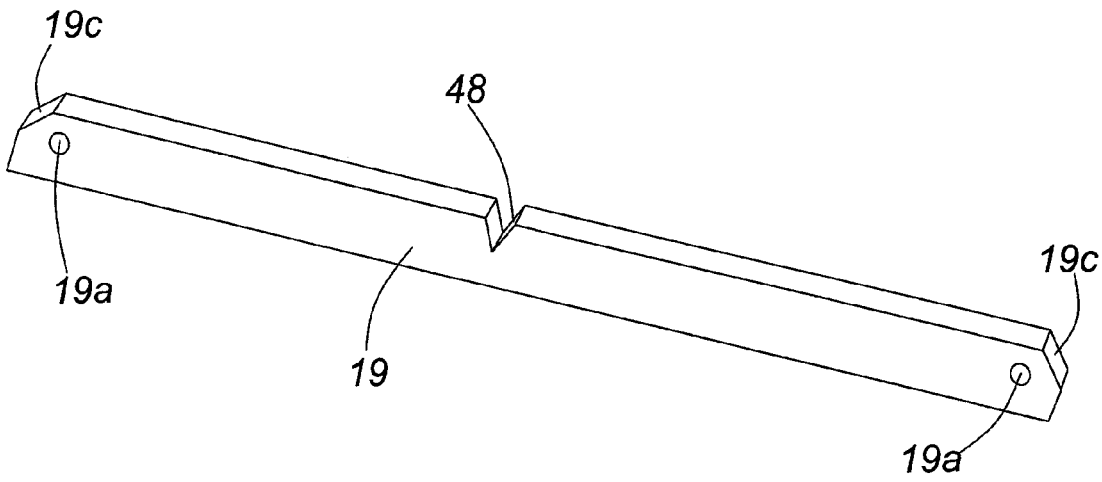

If the ground 22 is sloped such that a stabilizing element 5 is too short to engage the ground, an extension member 16 is mounted thereto using, for example, wood screws, as illustrated in FIG. 3*e*. The extension member 16 is, for example, made by the user by cutting a piece of 2×4 of appropriate length including a sufficient overlap of two feet or more.

The present invention has been described herein with regard to preferred embodiments. However, it will be obvious to persons skilled in the art that a number of variations and modifications can be made without departing from the scope of the invention as described herein.

What is claimed is:

1. A device for stabilizing a ladder comprising:

a rod for being disposed in a hollow rung of the ladder;

a first and a second hinge bracket disposed on a first and a second end portion of the rod, respectively, the first and the second hinge bracket being rotatable around a longitudinal axis of the rod;

a first stabilizing member and a second stabilizing member, an upper portion of the first and the second stabilizing member being rotatable mounted to the first and the second hinge bracket, respectively;

a first and a second self-centering washer disposed on the first and the second end portion of the rod, respectively, for centering the rod in the hollow rung; and, a first and a second hardware element disposed on the first and the second end portion of the rod, respectively, the first and the second hardware element interacting with the respective end portion of the rod for securing the ladder stabilizing device to the ladder such that a left hand side of the ladder is in direct contact with the first self-centering washer and a right hand side of the ladder is in direct contact with the second self-centering washer, said self-centering washer having only one aperture therethrough for accommodating the rod therein.

2. The device for stabilizing a ladder of claim 1 wherein the first and the second end portion of the rod are threaded and wherein the first and the second hardware element each comprise a self-locking nut.

3. The device for stabilizing a ladder of claim 1 comprising a connecting member having a predetermined length removable mounted to the first and second stabilizing member at a predetermined distance to a lower portion of the first and second stabilizing member.

4. The device for stabilizing a ladder of claim 3 comprising:

a solid center support unit attached to a mid-portion of the connecting member and for being engaged with a lower rung of the ladder; and, two cam-lock tie-down straps connected to a lower portion of the first and the second stabilizing member and for being connected to a lower portion of the ladder.

5. A device for stabilizing a ladder comprising:

a rod for being disposed in a hollow rung of the ladder;

a first and a second hinge bracket disposed on a first and a second end portion of the rod, respectively, the first and the second hinge bracket being rotatable around a longitudinal axis of the rod, the first and the second hinge bracket comprising a first and a second centering embossment, respectively, for centering the rod in the hollow rung;

a first stabilizing member and a second stabilizing member, an upper portion of the first and the second stabilizing member being rotatable mounted to the first and the second hinge bracket, respectively;

a first and a second hardware element disposed on the first and the second end portion of the rod, respectively, the first and the second hardware element interacting with the respective end portion of the rod for securing the ladder stabilizing device to the ladder such that a left hand side of the ladder is in direct contact with the first centering embossment of the first hinge bracket and a right hand side of the ladder is in direct contact with the second centering embossment of the second hinge bracket;

a connecting member having a predetermined length removably mounted to the first and second stabilizing member at a predetermined distance to a lower portion of the first and second stabilizing member;

a solid center support unit attached to a mid-portion of the connecting member and for being engaged with a lower rung of the ladder; and, two cam-lock tie-down straps connected to a lower portion of the first and the second stabilizing member and for being connected to a lower portion of the ladder.

6. The device for stabilizing a ladder of claim 5 wherein the first and the second end portion of the rod are threaded and wherein the first and the second hardware element each comprise a self-locking nut.

7. A device for stabilizing a ladder comprising:

a rod for being disposed in a hollow rung of the ladder;

a first and a second hinge bracket disposed on a first and a second end portion of the rod, respectively, the first and the second hinge bracket being rotatable around a longitudinal axis of the rod, the first and the second hinge bracket comprising a first and a second centering embossment, respectively, the first and the second centering embossment protruding into the hollow rung for centering the rod therein;

a first stabilizing member and a second stabilizing member, an upper portion of the first and the second stabilizing member being rotatable mounted to the first and the second hinge bracket, respectively; and, a first and a second hardware element disposed on the first and the second end portion of the rod, respectively, the first and the second hardware element interacting with the respective end portion of the rod for securing the ladder stabilizing device to the ladder such that a left hand side of the ladder is in direct contact with the first centering embossment of the first hinge bracket and a right hand side of the ladder is in direct contact with the second centering embossment of the second hinge bracket.

8. The device for stabilizing a ladder of claim 7 wherein the first and the second end portion of the rod are threaded and wherein the first and the second hardware element each comprise a self-locking nut.

* * * * *